United States Patent [19]

Ehlscheid et al.

[11] Patent Number: 4,674,258

[45] Date of Patent: Jun. 23, 1987

[54] APPARATUS FOR INSERTING ITEMS INTO AN ENCLOSURE

[75] Inventors: Gunter Ehlscheid; Klaus Munsch, both of Neuwied, Fed. Rep. of Germany

[73] Assignee: Winkler + Dunnebier Maschinenfabrik und Eisengiesserei GmbH & Co. KG, Neuwied, Fed. Rep. of Germany

[21] Appl. No.: 833,061

[22] Filed: Feb. 24, 1986

Related U.S. Application Data

[63] Continuation-in-part of Ser. No. 594,248, Mar. 28, 1984, abandoned.

[30] Foreign Application Priority Data

Apr. 2, 1983 [DE] Fed. Rep. of Germany ..... 3312087

[51] Int. Cl.[4] ..... B65B 5/00; B65B 35/30

[52] U.S. Cl. ..... 53/154; 53/569; 53/266 A

[58] Field of Search ..... 53/206, 266 R, 266 A, 53/266 C, 386, 460, 468, 473, 569, 572, 573, 154, 382

[56] References Cited

U.S. PATENT DOCUMENTS

| | | | |
|---|---|---|---|
| 2,308,010 | 1/1943 | Horowitz | 53/206 X |
| 2,736,999 | 3/1956 | Rouan et al. | 53/266 A X |
| 2,839,880 | 6/1958 | Boughton | 53/266 A X |
| 3,253,384 | 5/1966 | Huck et al. | 53/266 A X |
| 3,339,338 | 9/1967 | Brinck et al. | 53/572 |
| 3,490,195 | 1/1970 | Abramson | 53/386 X |
| 4,077,181 | 3/1978 | Asher et al. | 53/266 A X |
| 4,079,576 | 3/1978 | Morrison et al. | 53/226 A |
| 4,338,762 | 7/1982 | Gilligan et al. | 53/266 C X |

*Primary Examiner*—Robert L. Spruill
*Assistant Examiner*—Steven P. Weihrouch
*Attorney, Agent, or Firm*—Collard, Roe & Galgano

[57] ABSTRACT

A method and apparatus for inserting insert items into an enclosure, the insert items being selectively compiled by data coding. At the insertion station of the apparatus the insertion items are inserted without reduction in speed by top belts and bottom belts, past lateral insertion guides which are pivoted into the inside edges of the enclosure, directly into the enclosure which is aligned by means of movable cams operated in timed relation to the apparatus and which is opened by top and bottom vacuum devices. The filled enclosure is then conveyed by a segmental roller such that the insertion items retain their speed throughout the insertion operation and do not stop.

9 Claims, 6 Drawing Figures

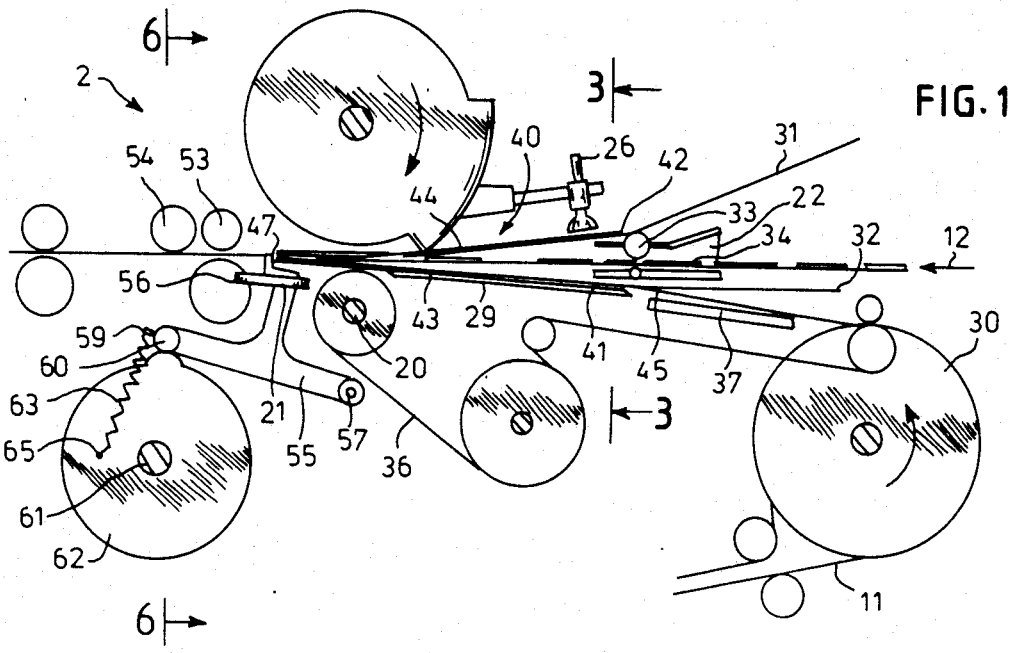
FIG. 1
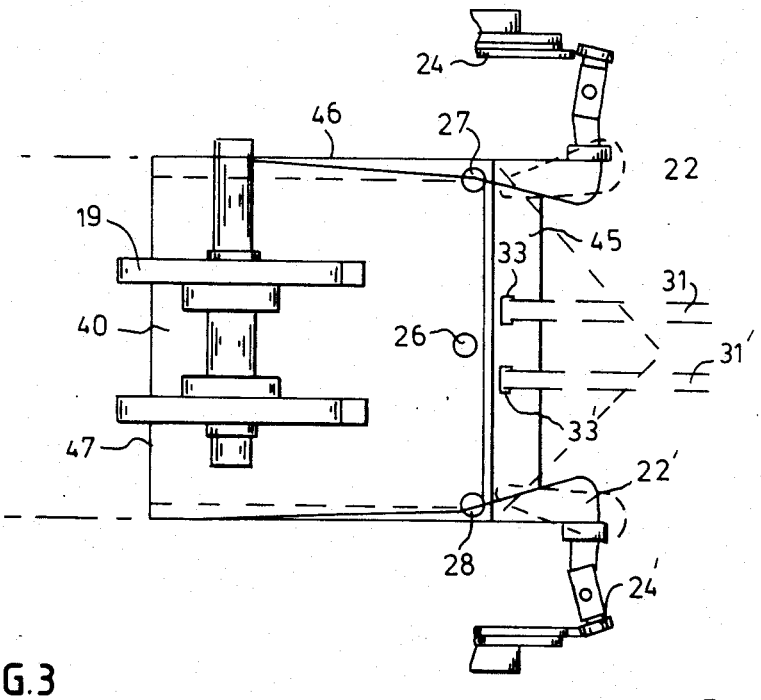
FIG. 2
FIG. 3
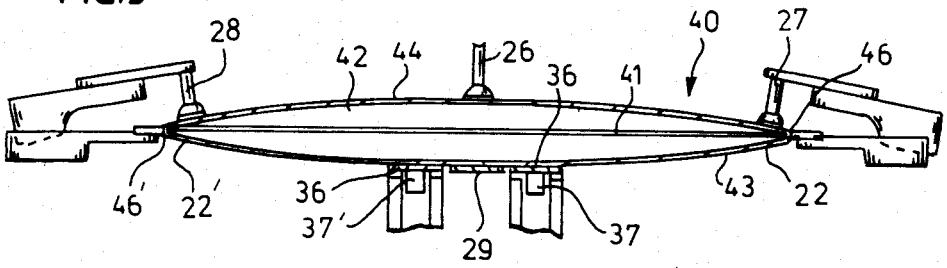

APPARATUS FOR INSERTING ITEMS INTO AN ENCLOSURE

This is a continuation-in-part of our earlier filed application Ser. No. 594,248, filed Mar. 28, 1984, entitled "METHOD AND APPARATUS FOR INSERTING ITEMS INTO AN ENCLOSURE" now abandoned.

The present invention relates to a method and apparatus for inserting items into an enclosure, preferably a letter envelope, a bag or the like, wherein the enclosure is separated from a stack and fed in, the closure flap then being opened. The enclosure is supplied upwards by a first conveyor to an inserting station and aligned thereat, the inserts —in the form of various flat elements, more particularly sheets —are separated and fed in from a number of magazines, collected by a second conveyor, then inserted into the enclosure, the filled enclosure is then conveyed onwards to the closing or franking station.

The design of apparatus of this kind presently focuses on enhancing performance, improving reliability of operation and careful treatment of the enclosures and inserts dealt with by the apparatus.

U.S. Pat. No. 3,059,391 discloses an insert which is comprised of various discrete elements being inserted into an enclosure, where the enclosure, which is supplied as a blank, is folded around the insert material which has been collected and stacked on a collecting chain in portions, the enclosure is then sealed. A disadvantage of this prior art apparatus is that it requires a large number of format tools, resulting in format changes being very expensive. Also, since the enclosure is folded around the insert material, the quality of the enclosure is much poorer than that of an enclosure produced on a special letter envelope or bag machine. The production capacity and speed of such known systems are low since they do not operate continuously. As noted, the insert item must be stopped in order to have the enclosure blank folded around it and then subsequently accelerated together with the enclosure up to conveying speed.

U.S. Pat. No. 4,077,181 discloses an insertion apparatus which separates the empty enclosure from a feed stack, feeds it, opens the closure flap of the enclosure and supplies the same to an insertion station. Insertion items, which have been separated from various feed stacks and fed in are delivered by a conveyor chain and collected on an offset plane, compressed and introduced by an insertion ram into the waiting open enclosure. The critical location in this apparatus is, as in all insertion apparatus of this kind, the insertion station. U.S. Pat. No. 4,337,609 describes this zone in greater detail. According to this Patent, the enclosure is supplied downwardly to the insertion station so that it is aligned by way of its bottom flap edge on abutments, its back being supported on a bent insertion deck and its closure flap resting on a support higher up. Through the agency of a solenoid which acts by way of a pivot mechanism on a finger device disposed above such deck, the enclosure is pressed on to the bent or angled deck so that its insertion orifice is opened. A second finger device then moves into the open enclosure, presses the front and back thereof apart from one another and enables the insertion ram to introduce the insert items. A disadvantage of this prior art apparatus is that the insert items cannot be compiled individually and selectively by data coding. Another disadvantage stems from the height difference between the conveying chain and the station for collecting and compressing the insert items which results in the discrete parts of the pressed stack of insert items being misaligned. This state of affairs, taken together with the lack of lateral insertion aids, makes it necessary for the enclosure to be considerably wider internally than the maximum width of the various insert items. In the case where the enclosure is formed with a window opening and an internally placed window, the insert item often catches on the window. Also, the elaborate insertion mechanism with the intermittently operating ram and the two finger devices are utilized only for a very small proportion of the machine cycle thus making for poor productivity. Another serious disadvantage is that both the envelope and the insert items stop during the insertion step and then have to be accelerated up to conveying speed, a further factor limiting productivity.

It is, therefore, a primary object of the present invention to devise an insertion apparatus which permits the insert material to be compiled individually and selectively by data coding. The purpose is to increase operational reliability and cycle speed of the apparatus by optimizing the critical zone, namely the insertion station, and by eliminating stoppage of the insertion material.

This object, as well as others which will hereinafter become apparent, is accomplished according to the invention wherein after the inserts, which are located laterally and in correct registration between the top and bottom conveying means, have been inserted into the enclosure, the filled enclosure is conveyed, either at the same speed as the arriving inserts or at a selected speed, in the direction of conveyance of the inserts such that the same move continuously in their direction of conveyance without stopping. According to the invention, the insertion station comprises: bottom suction belts for conveying the enclosure into the insertion position timed according to the speed of the apparatus; movable aligning cams movable into the path of conveyance in timed relation to the speed of the apparatus for ensuring correct registration of the enclosure; top and bottom vacuum devices for opening the enclosure; an insertion aid in the form of insertion guides controlled in timed movement according to the speed of the apparatus; and top and bottom conveyor belts which receive the inserts in the direction of movement thereof and convey them into the enclosure. The top and bottom conveyor belts are disposed with their reversing rollers positioned immediately before the insertion orifice of the enclosure to be filled. Further, the insertion station has, for continuous onward conveyance of the filled enclosure, a segmental roller which is driven in timed movement according to the speed of the apparatus and which cooperates with a backing roller.

The advantages provided by the invention are: the insertions can be compiled individually and selectively by data coding while the apparatus is in operation; the insertion material does not stop during insertion and during the subsequent conveyance of the filled enclosure so that a high insertion rate is achieved; enclosures with windows can be readily filled because of the use of top and bottom vacuum devices to open the enclosure in cooperation with the lateral insert guides which are pivoted—in in a cyclic manner; the insertion station and, therefore, the entire insertion apparatus is extremely reliable in operation and can provide high productivity.

Other objects and features of the present invention will become apparent from the following detailed description when taken in connection with the accompanying drawings which disclose one embodiment of the invention. It is to be understood that the drawings are designed for the purpose of illustration only and are not intended as a definition of the limits of the invention.

In the drawings, wherein similar reference characters denote similar elements throughout the several views:

FIG. 1 is a partial cross sectional view of the insertion station of the insertion apparatus of the present invention;

FIG. 2 is a plan view showing the insertion station according to the present invention and the top vacuum devices;

FIG. 3 is a cross sectional view taken along the line 3—3 of FIG. 1;

Figure 4:
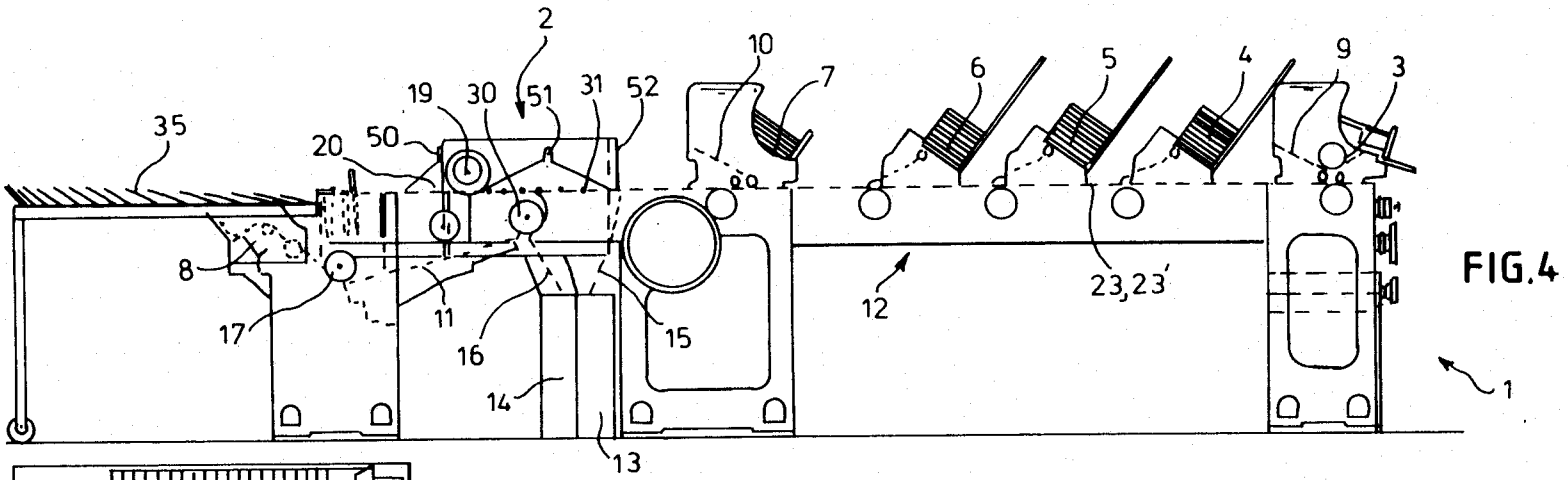
FIG. 4 is a side elevational view of the insertion apparatus.
Figure 5:
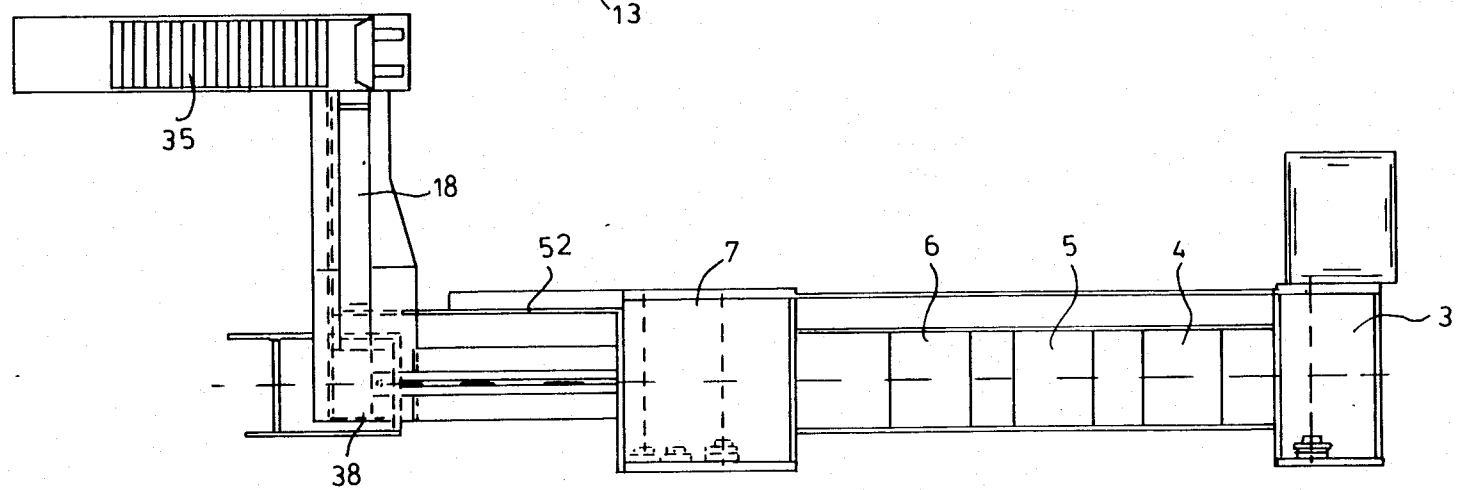
FIG. 5 is a plan view of the insertion apparatus.

Now turning to the drawings, there is shown in FIGS. 4 and 5, an insertion apparatus, designated 1, comprising, from right to left in the direction of conveyance of insert items 41, insert magazines 3 to 7 disposed above a second conveyor 12, an insertion station 2, a reversing station 38, a closing and franking station 18 at right angles to reversing station 38 and a delivery table or the like 35 disposed at right angles to station 18. An enclosure magazine 8 is disposed to the left of the reversal station 38 in registration with second conveyor 12. A first conveyor 11 extends from magazine 8 upwardly towards insertion station 2 at an acute angle.

Timed coupling—brake combinations (not shown) actuated by a central control station (not shown) drive magazines 3 to 7. Folding pockets 9 and 10 are provided below the feed rollers of magazines 3 and 7. The second conveyor 12 is embodied by two endless collecting chains 23 and 23'. A separator or the like 13 for insert material 41 is provided in second conveyor 12 at the end of chains 23 and 23' before station 2 and a mis—delivery facility 15 is provided below separator 13. A mechanism 17 for opening closure flap 45 of enclosure 40 is provided at the starting end of first conveyor 11. At the other end of first conveyor 11, a separator or the like 14 for enclosures 40 is provided below reversing wheel 30, separator 14 gives access downwards to a mis—delivery facility 16.

As clearly seen in FIG. 1, insertion station 2 is disposed in the plane of conveyance of insert material 41 and in prolongation of second conveyor 12. Where first conveyor 11 ends at reversing wheel 30 below second conveyor 12, conveyance of the enclosure is taken over by upwardly inclined suction belts 36 and 36' which extend to cooperating or backing roller 20. Belts 36 and 36' experience a negative pressure or vacuum timed according to the speed of the apparatus through the agency of a negative pressure source and negative pressure control, neither of which is shown. As can be clearly seen in FIG. 3, a suction and insertion plate 29 is disposed between belts 36 and 36' and before roller 20. Plate 29 is positioned to be coplanar with the top runs of belts 36 and 36'. Plate 29 experiences a negative pressure timed in accordance with the speed of the apparatus through the agency of a negative pressure source and control, neither of which is shown. Disposed after roller 20 are adjustable aligning cams 21 having actuating means which move cams 21 in timed movement in accordance with the speed of the apparatus, as more thoroughly described hereinafter. Top belts 31 and 31' and bottom belts 32 and 32' are disposed after chains 23 and 23' in the direction of conveyance of items 41. As can be seen in FIG. 4, top belts 31 and 31' are so secured by a bridgepiece 51 to frame wall 52 as to be upwardly pivotable. Rear reversing rollers 33 and 33' of top belts 31 and 31' and rear reversing rollers 34 and 34' of bottom belts 32 and 32' are so arranged as to be positioned between channel—like insertion funnels 22 and 22' immediately before insertion orifice 42 of enclosure 40 when the same is in the insertion position. The open ends of insertion funnels 22 and 22' face towards each other, can be rotated laterally before orifice 42, can have the spacing between them adjusted according to envelope format and, by means of actuators 24 and 24', can be moved through orifice 42 into inside edges 46 and 46' of enclosure 40 in timed movement according to the speed of the apparatus (see FIG. 2). Top vacuum devices 26, 27 and 28 are disposed above back 44 and near orifice 42 of enclosure 40 when the same is in the position for insertion. Central vacuum device 26 is always disposed vertically above plate 29 whereas vacuum devices 27 and 28 are disposed laterally at a distance from one another which can be adjusted in accordance with the format of the enclosures (see FIG. 3). Vacuum devices 26, 27 and 28 are subjected to negative pressure timed in accordance with the speed of the apparatus, through the agency of a negative pressure source and control, neither of which is shown, and can be raised and lowered vertically in timed movement according to the speed of the apparatus by actuating means which are also not shown.

A segmental roller 19 is disposed above roller 20 and, as can be seen in FIG. 4, is hingeably secured to frame wall 52 by means of bridgepiece 50 on which conveying rollers 53 and 54 are mounted.

In operation, the compilation of a filled enclosure 40, comprising an enclosure 40 and collectively compiled insertion items 41, is controlled by an internal or external control based on data coding. Items 41 are separated and fed in at magazines 3 to 7, folded as required in the case of magazines 3 and 7, transferred to chains 23 and 23' of second conveyor 12, aligned thereby and conveyed past separator 13 to top belts 31, 31' and bottom belts 32, 32'. Meanwhile, enclosure 40 is separated from the enclosure stack in magazine 8, fed in with its closure flap 45 to the rear and conveyed into opener 17 where its flap 45 is opened. Opened enclosure 40 is then conveyed on first conveyor 11 past separator 14 as far as roller 30 where it is taken over by belts 36, 36' and conveyed by way of its bottom flap edge 47 as far as cams 21 and 21' and thereby aligned by means of its edge 47. The operation of aligning cams 21 and 21' will be described in detail hereinafter. Plate 29 then engages enclosure 40 at the center of its downward—facing front 43 and locates it in position, after which cams 21 pivot downwardly.

Top vacuum devices 26, 27 and 28 descend from their normal position, engage back 44 of enclosure 40 and rise thus separating front 43 from back 44. Lateral guides 22, 22' move through enclosure orifice 42 into lateral inside edges 46, 46' of enclosure 40 to stretch the same (FIGS. 2 and 3). Insertion of items 41 into enclosure 40 begins while guides 22, 22' are still moving into enclosure 40. Top belts 31, 31' and bottom belts 32, 32', whose reversing rollers 33, 33' and 34, 34' are disposed immediately before enclosure orifice 42, convey items 41 into enclosure 40 (FIG. 1).

In the final phase of the insertion operation, plate 29 and vacuum devices 26, 27 and 28 release enclosure 40 and rollers 19 and 20 start to convey filled enclosure 40 onwards immediately after items 41 have just disappeared completely into enclosure orifice 42. Material 41 maintains its speed of conveyance throughout the insertion operation and filled enclosure 40 is conveyed to reversing station 38 by means of rollers 20, 53, 54 either at the latter speed or at some other selected speed.

After leaving station 38, the filled enclosure passes through sealing and franking station 18 where flap 45 of filled enclosure 40 is closed and, if necessary, filled enclosure 40 is franked. Filled enclosure 40 then goes to delivery table 35.

Figure 6:
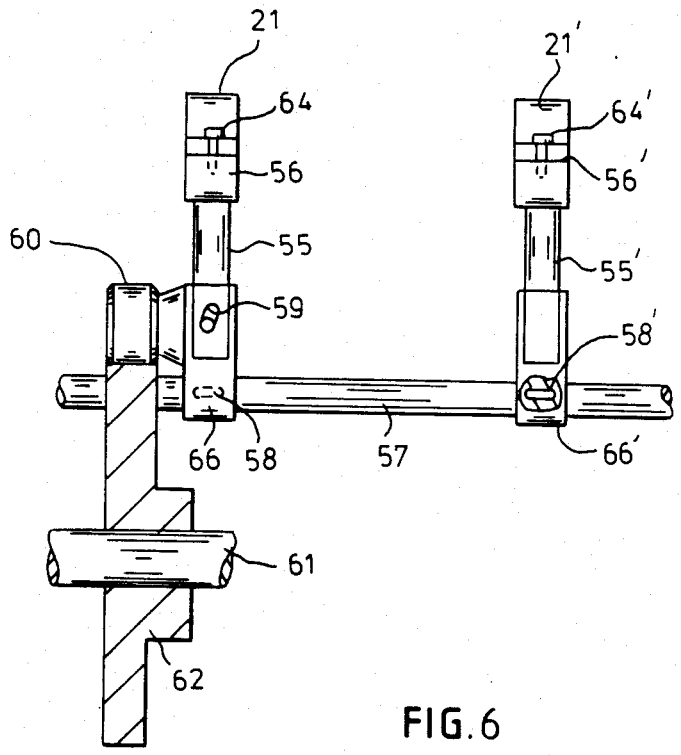
FIG. 6 is a partial cross sectional view of the insertion apparatus of FIG. 1 taken along the line 6—6 of FIG. 1.

As clearly seen in FIG. 1 and FIG. 6, the adjustable aligning cams 21 and 21' are adjustably fixed on lever arms 56 and 56' of levers 55 and 55' by means of screws 64 and 64', respectively. Aligning cams 21, 21' are disposed downstream in the direction of travel behind segmental roller 19 and backing roller 20. One end of levers 55 and 55' is fixed at their lugs 66 and 66' on shaft 57 by means of adjusting springs 58 and 58'. Shaft 57 is pivotally mounted to the side frame of the insertion apparatus so that levers 55 and 55' can be pivoted about shaft 57. At the free end of levers 55 and 55', a cam roller 60 is secured and follows on cam disk 62. Cam disk 62 is fixedly disposed on center shaft 61 which is driven according to the cycle of the insertion apparatus. Cam roller 60 is maintained on the running surface of cam disk 62 by means of spring 63 which is secured to the apparatus side frame by bolt 65 and secured to lever 55 by means of bolt 59. The cam lobe of cam disk 62 causes levers 55 and 55' to pivot, thus moving aligning cams 21 and 21' into the path of travel of bottom flap edge 47 of enclosure 40 so as to align bottom edge 47 and momentarily prevent the continued movement of enclosure 40 as inserts or items 41 are fed into the enclosure. Once the insertion step is completed, aligning cams 21 and 21' disengage from bottom flap edge 47 of enclosure 40 as a result of the operation of cam disk 62 which is timed in relation to the insertion apparatus. The filled enclosure 40 is then free to be moved along the path of travel.

Thus, while only one embodiment of the present invention has been shown and described, it will be obvious that many changes and modifications may be made thereunto, without departing from the spirit and scope of the invention.

What is claimed is:

1. Apparatus for inserting inserts into an enclosure having upper and lower surfaces, side and bottom edges and an insertion orifice, such as a letter envelope, bag or the like, wherein the insertion station comprises:

suction belts for conveying the enclosure in the direction of travel into the insertion position in timed movement according to the speed of the apparatus;

movable aligning cams for correctly registering the enclosure moveable into the path of travel of the enclosure to engage the bottom edge thereof;

means for moving said movable aligning cams comprising a cam moveable in timed relation to the speed of said apparatus and a cam follower engaging said cam and operatively connected to said alinging cams;

biasing means normally biasing said alinging cams out of the direction of travel of the enclosure;

a bottom stationary suction and insertion plate and a plurality of top vertically moveable vacuum devices disposed in the insertion zone of the insertion station upstream of said aligning cams and operating in timed relation to the speed of the apparatus to engage the enclosure by vacuum near the insertion orifice of the enclosure and open the same;

laterally arranged insertion guides in the form of channel-like funnels the open ends of which face each other, said insertion guides being rotatable so as to extend into the enclosure insertion orifice at the lateral inside edges thereof in timed movement according to the speed of the apparatus;

continuously-moving top and bottom conveyor belts which receive the inserts in the direction of movement thereof and convey them into the enclosure, each of said conveyor belts having a reversing roller and being disposed with the reversing roller positioned immediately before the insertion orifice of the enclosure to be filled; and a segmental roller, driven in timed movement with the speed of the apparatus, cooperating with a backing roller and conveying rollers to continue conveyance of the filled enclosure.

2. The apparatus as defined in claim 1, wherein said biasing means comprises a spring.

3. The apparatus as defined in claim 1, wherein said aligning cams are pivotally mounted on said apparatus.

4. The apparatus as defined in claim 1, wherein said aligning cams are adjustable.

5. The apparatus as defined in claim 1, which further comprises magazines arranged consecutively along a conveyor for conveying the inserts to the insertion station, said magazines having timed clutch—brake combinations with controls permitting selective compilation of the inserts timed in accordance with the speed of the apparatus while the same is in operation.

6. The apparatus as defined in claim 5, wherein said controls are internal.

7. The apparatus as defined in claim 5, wherein said controls are external.

8. The apparatus as defined in claim 1, which further comprises a separator for routing inserts to a mis-delivery facility cooperating with a conveyor conveying the inserts to the insertion station and positioned before the insertion station.

9. The apparatus as defined in claim 1, which further comprises a separator for routing enclosures to a mis-delivery facility cooperating with a conveyor conveying enclosures to the insertion station and positioned before the insertion station.

* * * * *